United States Patent [19]

Trimble

[11] Patent Number: 4,754,263

[45] Date of Patent: Jun. 28, 1988

[54] BURGLAR ALARM SYSTEM

[76] Inventor: Currillies Trimble, 17912 Invermere Rd., Cleveland, Ohio 44128

[21] Appl. No.: 941,153

[22] Filed: Dec. 12, 1986

Related U.S. Application Data

[63] Continuation-in-part of Ser. No. 455,066, Jan. 3, 1983.

[51] Int. Cl.[4] ..... G08B 13/08

[52] U.S. Cl. ..... 340/545; 340/541

[58] Field of Search ..... 340/541, 545, 542; 200/61.93

[56] References Cited

U.S. PATENT DOCUMENTS

| | | | |
|---|---|---|---|
| 3,383,674 | 5/1968 | Soltau et al. | 340/545 X |
| 3,537,094 | 10/1970 | Hawkins et al. | 340/545 X |
| 3,634,846 | 1/1972 | Fogiel | 340/545 X |
| 3,790,944 | 2/1974 | Yarwood | 340/545 |
| 3,978,467 | 8/1976 | Albert | 340/545 X |

*Primary Examiner*—Joseph A. Orsino, Jr.
*Assistant Examiner*—Jeffrey A. Hofsass
*Attorney, Agent, or Firm*—Richard R. Walling; Charles R. Rust

[57] ABSTRACT

An alarm system for sensing entry through premise doors and windows, including primary and secondary circuits joined by a transformer. The primary circuit has an alarm including a siren and floodlight plus a time delay relay (with automatic reset) for activating the alarm for preset periods. A siren delay tube permits siren on-off operation in preset cycles. The secondary contains a plurality of automatic resetting door and window switches. A solenoid operated trigger switch has switch contacts wired to energize the time delay relay whereby the trigger switch solenoid is wired in the secondary for actuation by any door or window switch. A rocker switch in the primary selectively energizes the floodlight without activating the siren and selectively deactivates primary power to the transformer in coaction with time delay relay when the siren and floodlight are activated thus deactivating secondary power to the doors and windows.

The system has a switch box containing a main toggle switch for deactivating the system for repair purposes plus a switchbox door operated microswitch enabling opening of the premise doors and windows without energizing the alarm once the switch box door is opened. Pilot lights are provided for indicating floodlight actuation, and for indicating when the alarm system main power is on. Test switches are wired into the system for testing the alarm system without activating the alarm and for testing the alarm system in place of premise door and window switch activation. Instant entry sensing with minute closure opening is provided.

1 Claim, 3 Drawing Sheets

BURGLAR ALARM SYSTEM

This invention is a continuation-in-part of my copending application Ser. No. 455,066 filed Jan. 3, 1983.

BACKGROUND OF THE INVENTION

This invention relates to burglar alarms and more particularly to a door and window entry sensing system that instantly detects minute closure openings.

There has long been a need for a door and window alarm system that instantly detects the slightest opening of the door or window by means of super-sensitive door and window switches that automatically reset themselves. In systems having sirens and floodlights, provision should be made for shutting off the siren or alarm when only the floodlights are to be turned on. Also, when the floodlights and siren are on, low voltage power to the doors and window must be shut off. The siren should have control means enabling the siren to go on and off in preselected time cycles. Test switches should be provided for testing the alarm system without energizing the alarms and for testing the system in lieu of door and window switch actuation. There should be provision for opening of the doors for intended entry and opening the windows for ventilation without activating the alarm.

It is an object of the invention to provide an alarm system for sensing attempted entry through doors and windows by means of door and window switches that instantly detect even the slightest opening of the closure.

It is a further object of the invention to provide an alarm system of the above type having a siren and floodlight wherein the siren may be shut off when just floodlight use is desired.

A further object of the invention is to provide an alarm system of the above type wherein the low voltage power to the doors and windows is shut off when the alarm is activated.

A further object of the invention is to have the door and window switches automaticallv reset themselves after actuation.

A further object is to have the siren sound-off in preset on-off cycles.

A further object of the invention is to have the alarm automatically shut off after a preset time interval.

A further object of the invention is to provide means for easily deactivating the alarm system interiorly of the premises upon intentional opening of the door or window.

A further object of the invention is to provide means for testing components of the alarm system without activating the alarm.

BRIEF DESCRIPTION OF THE INVENTION

Briefly, the foregoing objects are accomplished by the provision of an electric alarm system for sensing attempted entry through doors and windows in a premise or house including an electric power source, a primary circuit wired to the power source, a secondary circuit, and a transformer wired to and between the primary and secondary circuits for providing low voltage electricity to the secondary circuit. A siren and floodlight are wire in the primary circuit along with a time delay relay for preselectively energizing such siren and floodlight. A plurality of entry sensing door and window switches are wired in the secondary circuit. A solenoid operated trigger switch has its switch contacts wired to energize or actuate the time delay relay and, in coaction therewith, the trigger switch solenoid is wired into the secondary circuit for actuation by any of the door and window switches.

A four pole rocker switch is wired into the primary circuit for selectively energizino the floodlight without activating the siren; and for selectively deactivating primary power to the transformer, in coaction with the time delay relay, when the siren and floodlight are activated thereby deactivating secondary low voltage power to the doors and windows when the siren and floodlights are on.

A siren delay tube is wired in the primary system, between the siren and the time delay relay, for energizing the siren for predetermined periods of time.

There is also provided a main switch hox with a main toggle switch disposed therein and wired into the primary circuit to provide manual deactivation of the alarm system for repair purposes and the like. A microswitch is disposed in the main switch box adjacent the switch box door and structured for on-off operation by such door. Such microswitch is wired between the trigger switch and the time delay relay enabling opening of the house doors and windows without energizing the siren when the switch box door is opened.

Also provided are a plurality of pilot lights wired in the primary circuit to remotely indicate when the main toggle switch is on. A floodlight indicator light is wired in the primary circuit, in parallel with the floodlight, for remotely indicating when the floodlight is energized. An alarm test switch is wired in the primary circuit between the siren delay tube and the power source for testing the alarm system without energizing the siren.

Additionally, a line testing button switch is disposed in the secondary circuit, in series with the trigger switch solenoid, for test energizing the alarm system in lieu of house door and window switch activation.

All of the above elements and devices coact to provide a foolproof entry sensing alarm system that is extremely sensitive to even the slightest movement of the house doors and windows thereby giving instant notification of an unauthorized intruder. With prior conventional systems, the intruder may already be in the home before the alarm sounds, but with the present system, even the slightest pressure on a door or window triggers the alarm. The system is capable of detecting any movement of the doors or windows regardless of whether the windows are partially opened or closed. With the window switch reset feature, once the window switch is set off, it almost instantly springs back to its initial position ready for action again. The system may be tied into a telephone line to automatically notify the police. The outside lights may be turned on independently of the alarm system anytime you wish to light the area surrounding the house. Since the system is mechanical in activation, rather than magnetic, the alarm cannot be activated by lightning, windstorms or other related forms. The siren may be set to sound anywhere from a few seconds to a half an hour. The outside lights may also be set in like manner. Interior alarm activating switches enable the sounding of the alarm from anywhere inside the house should the need arise.

Other objects and advantages of the invention will be apparent from the following description taken in conjunction with the drawings wherein:

BRIEF DESCRIPTION OF THE DRAWINGS

In the drawings, like numbers and letters are used to identify like and similar parts throughout the several views.

DESCRIPTION OF THE PREFERRED EMBODIMENTS

Figure 2:
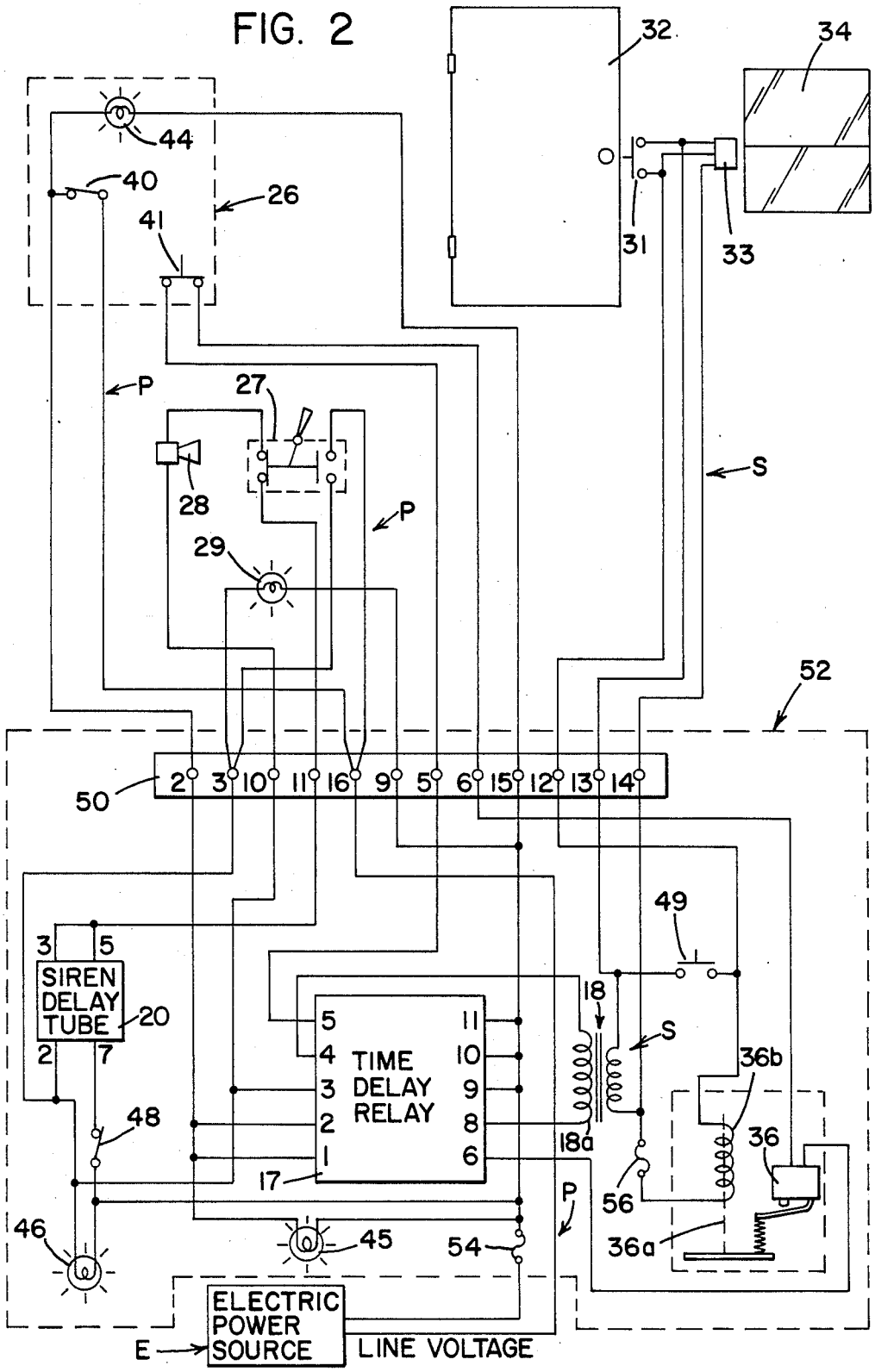
FIG. 2 is a schematic assembly-type wiring diagram of the alarm system shown in FIG. 1.

Referring first to FIG. 2, there is shown a schematic assembly wiring diagram of an electric alarm system of the invention for sensing unauthorized attempted entry through doors and windows of a house or premise including, as main components, an electric power source E (110 volts ac for example), a primary circuit generally designated as P operationally wired to the power source E, a secondary circuit generally designated as S, and a transformer 18 operationally wired between the primary and secondary circuits for providing low voltage electricity (24 volts for example) to the secondary circuit. Other main components include the time delay relay 17 operationally wired in the primary circuit for setting the length of time for operating the alarm, the siren delay tube 20 which permits on-off siren energization in preselected continuous cycles, the main switch box 26 which houses a system pilot light 44 and certain system switches 40,41, a multi-function rocker switch 27, the siren 28, and the floodlight 29, all such components to be hereinafter explained in more detail.

The system also includes a plurality of entry sensing door and window switches such as the door switch 31 for the door 32 and the window switch 33 for the window 34, such switches being operationally wire in the secondary circuit S. The window switch 33 is preferably of the type shown and described in my U.S. Pat. No. 4,531,029 which issued July 23, 1985, which switch is of the resetting type and is extremely sensitive to provide instant detection of even the slightest movement of the closure.

A significant component of the invention is the aforementioned four-pole rocker switch 27 which is operationally wired in the primary circuit P for selectively energizing the floodlight 29 without activating the alarm means (such as the siren 28). The rocker switch 27 also functions to selectively deactivate primary power to the transformer 18 in coaction with the time delay relay 17 when the alarm means is activated thus deactivating secondary power to the doors and windows for safety purposes.

Figure 3:
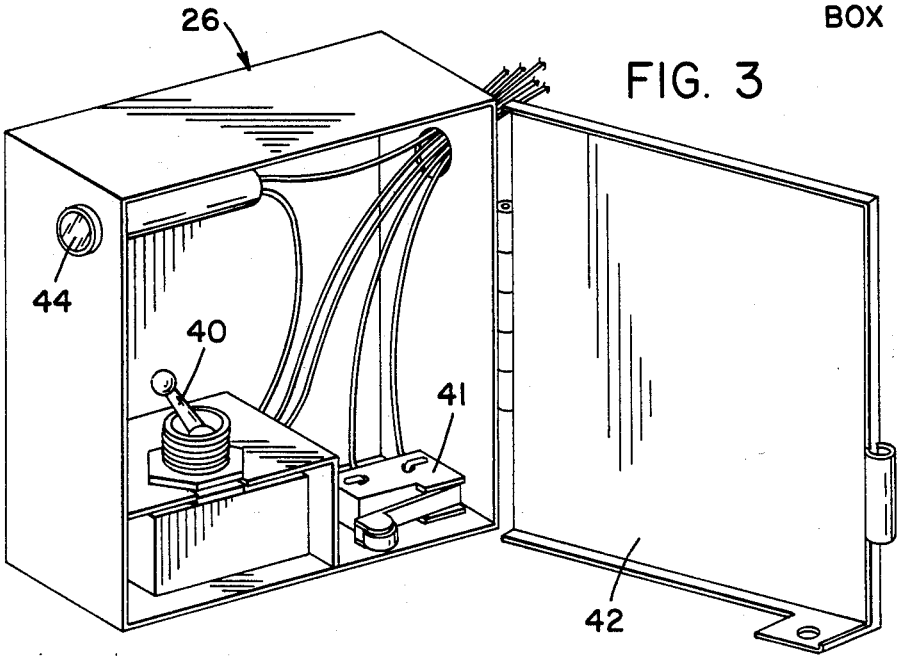
FIG. 3 is a perspective view if the main switch box shown schematically in FIG. 2, and showing components of the invention disposed therein.

The main switch box 26 (FIGS. 2 and 3) contains a main toggle switch 40 which is wired in the primary circuit so as to permit cutting off the primary power thus deactivating the alarm system for repair purposes and the like. Also, a microswitch 41 is disposed in the main switch box 26 adjacent the switch box door 42 for operation thereby as shown. The microswitch contacts are wired between the trigger switch 36 and the time delay relay 17 enabling the opening of the house door and windows without energizing the alarm when the switch box door is opened at which time the microswitch is off.

The system has a plurality of pilot lights which may be placed in remote locations in the house, such pilot lights 44, 45 being operationally wired in the primary circuit P to remotely indicate when the main toggle switch 40 is on. Additionally, a floodlight indicator light 46 is wired in the primary circuit P in parallel with the floodlight 29 for remotely indicating when the floodlight is energized.

An alarm test switch is provided in the form of the normally-closed slide switch 48 which is wired in the primary circuit P between the siren delay tube 20 and the primary power source E for testing the alarm system without energizing the siren 28.

A line testing button switch 49 is wired in the secondary circuit S in series with the trigger switch solenoid **36*b* for test energizing the alarm system in place of actuation of the door or window switches 31,33**.

A terminal strip 50 is provided having numbered connector points to facilitate assembly and tracing of wiring. Also, the time delay relay 17 and the siren delay tube 20 have numbered connection points for wiring simplification.

An alarm system housing 52 is provided which contains most of the basic components of the alarm system.

Overload protection is effected by means of the fuse 54 which protects the primary circuit P, and the fuse 56 which protects the secondary circuit S.

Figure 1:
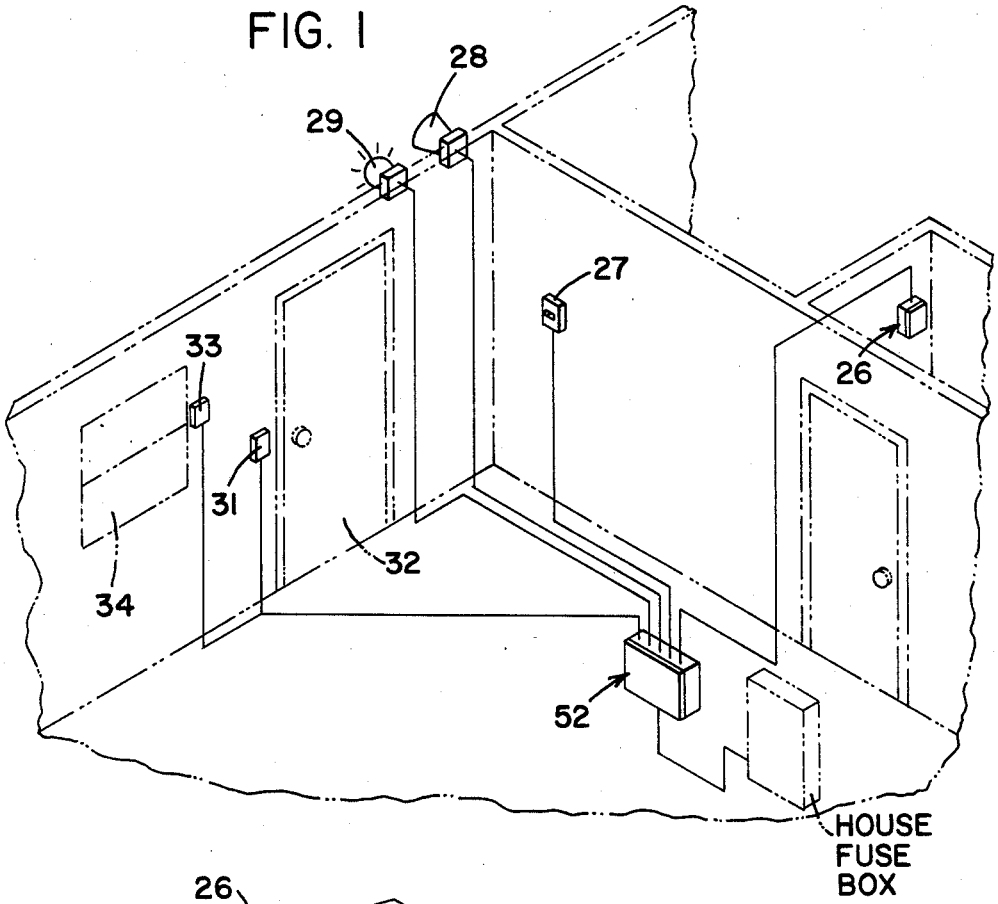
FIG. 1 is a broken perspective view of a house interior and showing an alarm system of the invention disposed therein.

The various components of the alarm system may be placed in suitable and strategic locations throughout the house. A typical layout is shown in FIG. 1.

Figure 4:
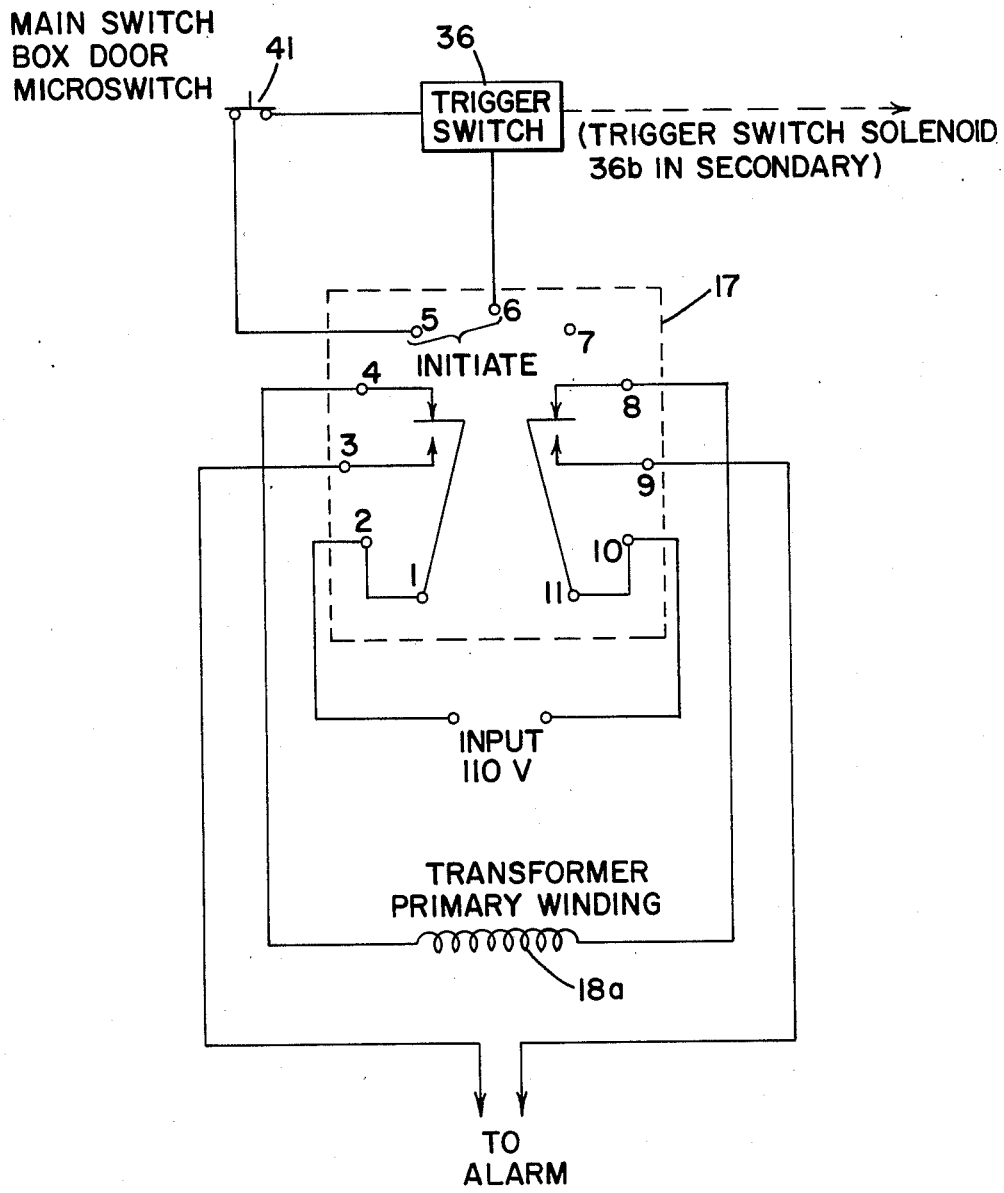
FIG. 4 is an abbreviated schematic wiring diagram showing the basic interior switch wiring of the time delay relay shown in symbol form in FIG. 2.

FIG. 4 illustrates the basic interior switch wiring of the time delay relay 17. It is to be noted that relay terminals 5 and 6 are the initiate terminals, whereby with the main switch box door microswitch 41 being closed, the trigger switch 36 then has control of such initiate terminals 5 and 6. With the trigger switch solenoid **36*b* (FIG. 2) being disposed in the secondary S and under the control of the door switch 31 or the window switch 33, such door and window switches, in effect, directly trigger the time delay relay 17. More specifically, solenoid 36*b* has a plunger 36*a* connected to trigger switch 36. When solenoid 36*b* is triggered, plunger 36*a* pulls upward thus triggering switch 36, which, in effect, directly triggers relay 17. Time delay relay contacts 4 and 8 (FIG. 4) are wired to the transformer primary winding 18*a*. Thus FIG. 4 shows the time delay relay interior contacts energizing the transformer 18. When the time delay relay 17 is actuated, 110 volt power is switched by the relay 17 from contacts 4 and 8 to contacts 3 and 9 thus shutting off the transformer and turning on the alarm. The relay 17** has a timer adjustment knob (not shown) to adjust the time the alarm is to be on.

In operation, with the primary 110 volt supply on, switch 41, and switch 48 should be closed, thus energizing the transformer 18 to provide 24 volt power to the secondary S. Rocker switch 27 should be in the "siren-on" position shown in FIG. 2. Attempted entry through the door 32 or the window 34 will trip the door switch 31 or the window switch 33, whereby either of such switches will energize the trigger switch solenoid **36*b*. The energized solenoid 36*b* actuates the trigger switch 36 which actuates the time delay relay 17. Relay 17 actuation switches 110 volt power (interiorly of such relay) from relay contacts 4 and 8 (the transformer contacts) to alarm contacts 3 and 9 (as best shown in FIG. 4) to sound the alarm such as the siren 28 and the floodlight 29. At the end of the time for which the relay 17** is set (a few seconds up to thirty minutes) the alarm will shut off.

Rocker switch 27 is shown in FIG. 2 in "siren-on" position for sounding the alarm if unauthorized door or window entry is attempted. If it is desired to use the floodlight 29 independent of the alarm, the rocker switch 27 should be switched to its other position, at which time the siren 28 will be deactivated.

The siren delay tube 20 enables the siren 28 to execute continuous on-off operation. For example, the siren could be on for three seconds and off for two seconds, with such cycle being repeated indefinitely or until the time delay relay 17 setting shuts off the alarm as aforementioned.

Since the time delay relay 17, the siren delay tube 20, and the rocker switch 27 are available in the marketplace, such elements, per se, do not form the invention. The invention resides in the combination of such elements in coaction with the novel switch and wiring arrangement as outlined herein and as shown in the drawings.

The terms and expressions which have been employed herein are used as terms of description, and not of limitation, and there is no intention, in the use of such terms and expressions, of excluding any equivalents of the features shown and described, or portions thereof, but it is recognized that various modifications are possible within the scope of the invention claimed.

I claim:

1. An electric alarm system for sensing attempted entry through doors and windows in a premise comprising: an electric power source, a primary circuit operationally wired to said power source, a secondary circuit, a transformer operationally wired between said primary and secondary circuits for providing low voltage electricity to the secondary circuit, a siren operationally wired in the primary circuit, a floodlight operationally wired in the primary circuit, a time delay relay operationally wired in the primary circuit for preselectively energizing said siren and said floodlight, a plurality of entry sensing door and window switches operationally wired in the secondary circuit, a solenoid operated trigger switch having a solenoid and having its switch contacts operationally wired to energize said time delay relay whereby the trigger switch solenoid is operationally wired in the secondary circuit for actuation by any of said door and window switches, a four-pole rocker switch operationally wired in the primary circuit for selectively energizing the floodlight without activating the siren and for selectively deactivating primary power to the transformer in coaction with said time delay relay when the siren and floodlight are activated thus deactivating secondary low voltage power to the doors and windows, a siren delay tube operationally wired in the primary circuit between the siren and the time delay relay for energizing the siren for predetermined periods of time, a main switch box, a main toggle switch disposed in the switch box and operationally wired in the primary circuit for manually deactivating the alarm system for repair purposes, said switch box having a door, a microswitch disposed in the main switch box adjacent the switch box door and structured for on-off operation by such door, said microswitch being operationally wired between the trigger switch and the time delay relay enabling opening of the premise doors and windows without energizing the siren when the switch box door is opened, a plurality of pilot lights operationally wired in the primary circuit to remotely indicate when said main toggle switch is on, a floodlight indicator light operationally wired in the primary circuit in parallel with the floodlight for remotely indicating when the floodlight is energized, an alarm test switch operationally wired in the primary circuit between the siren delay tube and the power source for testing the alarm system without energizing the siren, and a line testing button switch disposed in the secondary circuit in series with the trigger switch solenoid for test energizing the alarm system in lieu of premise door and window switch activation.

* * * * *